US005690335A

United States Patent [19]

Skratulia

[11] Patent Number: 5,690,335

[45] Date of Patent: Nov. 25, 1997

[54] METHOD OF PLAYING A WAGERING GAME

[76] Inventor: John Skratulia, 11402 Howard St., Whittier, Calif. 90601

[21] Appl. No.: 610,419

[22] Filed: Mar. 4, 1996

[51] Int. Cl.[6] ..... A63F 1/00; A63F 9/04

[52] U.S. Cl. ..... 273/292; 273/146

[58] Field of Search ..... 273/146, 292, 273/309, 274, 248; 463/12, 13

[56] References Cited

U.S. PATENT DOCUMENTS

| | | | |
|---|---|---|---|
| 4,535,994 | 8/1985 | Cowan | 273/146 |
| 5,018,744 | 5/1991 | Patracuolia | 273/248 |
| 5,397,128 | 3/1995 | Hesse et al. | 273/292 |
| 5,529,309 | 6/1996 | Bartlett | 273/292 |

FOREIGN PATENT DOCUMENTS

| | | | |
|---|---|---|---|
| 213695 | 2/1955 | Australia | 273/146 |

OTHER PUBLICATIONS

"Pai Gow" WIN magazine, Apr. 1992, pp. 39, 40 and 70.

*Primary Examiner*—Benjamin H. Layno
*Attorney, Agent, or Firm*—Timothy T. Tyson; Ted Masters

[57] ABSTRACT

A method of apportioning wagers between a plurality of game players includes each player receiving two cards, and having the option of drawing one additional card. The playing cards have numerical values of, ace equals one, picture cards equal zero, and all other cards equaling their face value. The cards in each player's hand are summed to form a numerical total. The least significant digit of the numerical total determines the winner, wherein a least significant digit of nine or closest thereto is the best hand. Additional game features include (1) a provision which eliminates ties (pushes), (2) a set of special dice (300/400) which are used to determine an action player, (3) a secondary player-banker who takes over for the player-banker if the bank does not reach all the players, and (4) a fast-action-bank feature in which the role of the player-banker may change during a round of play.

29 Claims, 6 Drawing Sheets

METHOD OF PLAYING A WAGERING GAME

TECHNICAL FIELD

The present invention pertains generally to wagering games and more particularly to a method of playing a wagering game wherein each player receives two cards, and has the option of drawing one additional card.

BACKGROUND ART

The present invention bears similarity to the existing game of Pan 9 also known as Asian Super 9 or Super Pan 9, however it includes several unique features and therefore departs substantially from Pan 9 in playing methodology. The existing game of Pan 9 is well know in the art and is played in numerous casinos in California and throughout the world. California Baccarat comprises a game similar to the present invention which includes the addition of a "wild card Joker". Information regarding California Baccarat is available from the Commerce Casino, 6131 E. Telegraph Rd., Commerce, Calif. 90040. U.S. Pat. No. 5,452,900 discloses a banking method known as "Fast Action Bank", which is utilized in one of the embodiments of the present invention.

DISCLOSURE OF INVENTION

The present invention is directed to a method of playing a wagering game wherein a player is dealt two cards and has the option of drawing a third card. The objective of the game is for a player to achieve a numerical total of nine or closest thereto. A proposed name for the present invention is "High-Nine".

The present invention differs from Pan 9 in several important ways. A standard 52 card deck of playing cards is used, rather than removing all cards seven through ten as is done in Pan 9. Therefore, in the present invention it is possible to achieve a numerical total of nine each time a card is drawn. Additionally, in a preferred embodiment of the present invention a player receives two cards with an option of drawing a third card, as opposed to receiving three cards with an option of drawing a fourth as in Pan 9. Therefore the play of the present invention is faster than Pan 9. Also, in the present invention their are no ties (pushes). Finally, the present invention can employ three unique playing features, which are; (1) three special dice to determine the action player, (2) a secondary player-banker who takes over for the player-banker should the bank not reach all players, and (3) a fast action bank banking method wherein the player-banker changes during a round of play.

In accordance with a preferred embodiment of the invention, a standard 52 card deck of playing cards is used wherein, the cards have numerical values of ace equals one, picture cards equal zero, and all other cards equal to their face value. The players each receive two cards and have the option of drawing a third card. The cards in each player's hand are summed to from a numerical total, and the least significant digit of the total is determined. The player having a least significant digit of nine or closest thereto has the better hand and wins the wager from the other player.

In accordance with an important aspect of the invention, the ranking of least significant digit from highest to lowest is; nine, eight, seven, six, five, four, three, two, one, and zero.

In accordance with an important feature of the invention, the ranking of single cards from highest to lowest is; nine, eight, seven, six, five, four, three, two, ace (one), king, queen, jack, and ten.

In accordance with an important aspect of the invention, a procedure is utilized to eliminate (break) ties between contending players.

In accordance with another important aspect of the invention, if two contending players each have a numerical total having the same least significant digit, the player having the highest ranking single card has the better hand.

In accordance with another important feature of the invention, if two contending players each have the same least significant digit and the same highest ranking single card, the player having the highest ranking second card has the better hand.

In accordance with another important aspect of the invention, if two contending players each have the same least significant digit, the same highest ranking single card, the same highest ranking second card, the player having the highest ranking third card has the better hand.

In accordance with another important feature of the invention, if two contending players have identical hands, the player-banker is declared the winner.

In accordance with a preferred embodiment of the invention, a set of special dice are used to determine the action player.

In accordance with a preferred embodiment of the invention, when the bank does not reach all players, a secondary player-banker replaces the player-banker and continues to sequentially compare hands and settle wagers with the remaining players.

In accordance with an important aspect of the invention, a fast action bank banking method is used wherein the player-banker changes during a round of play.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1A:
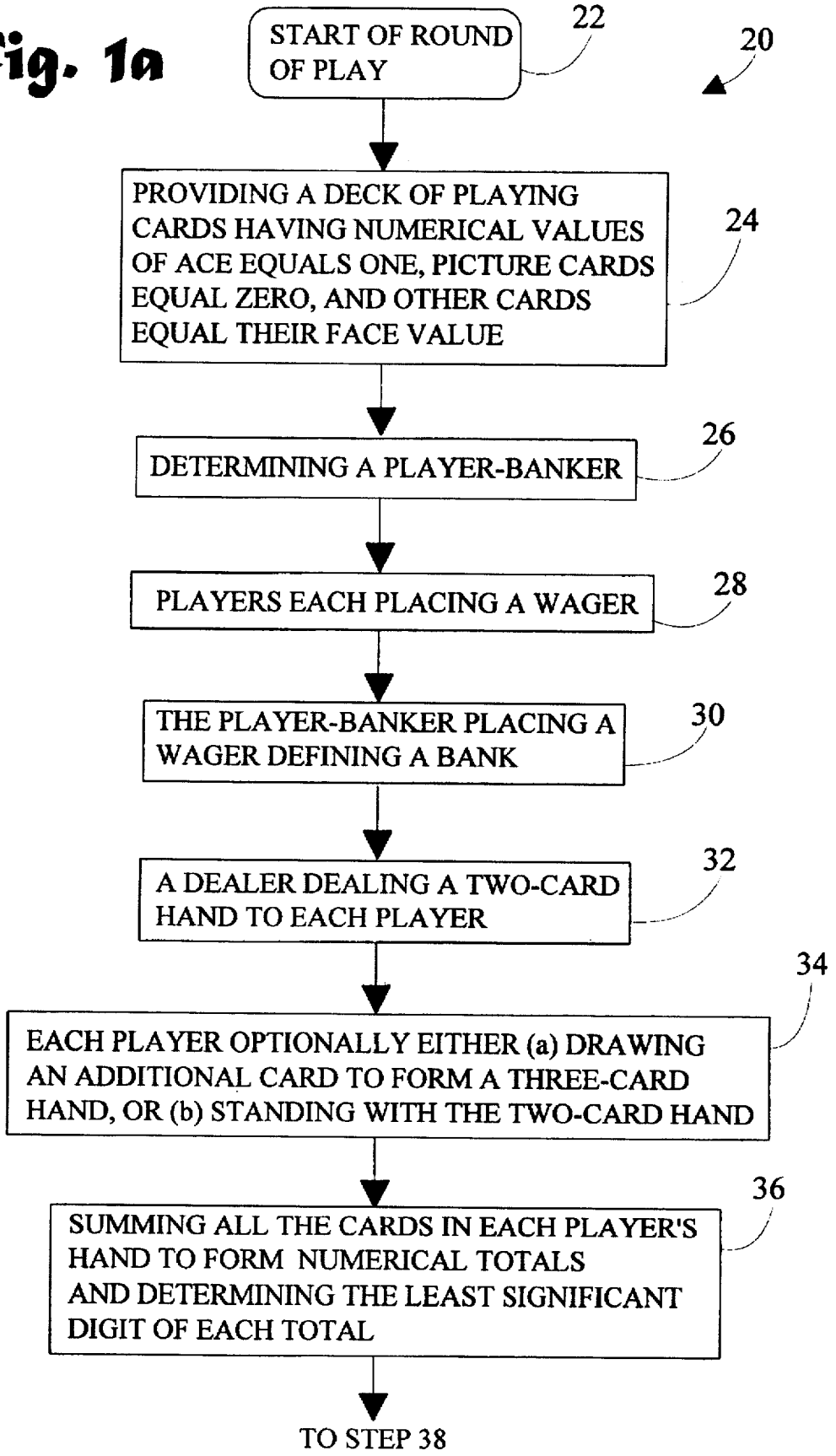
FIGS. 1*a* and 1*b* is a flow diagram illustrating the steps and method of play of a wagering game in accordance with the present invention.
Figure 1B:
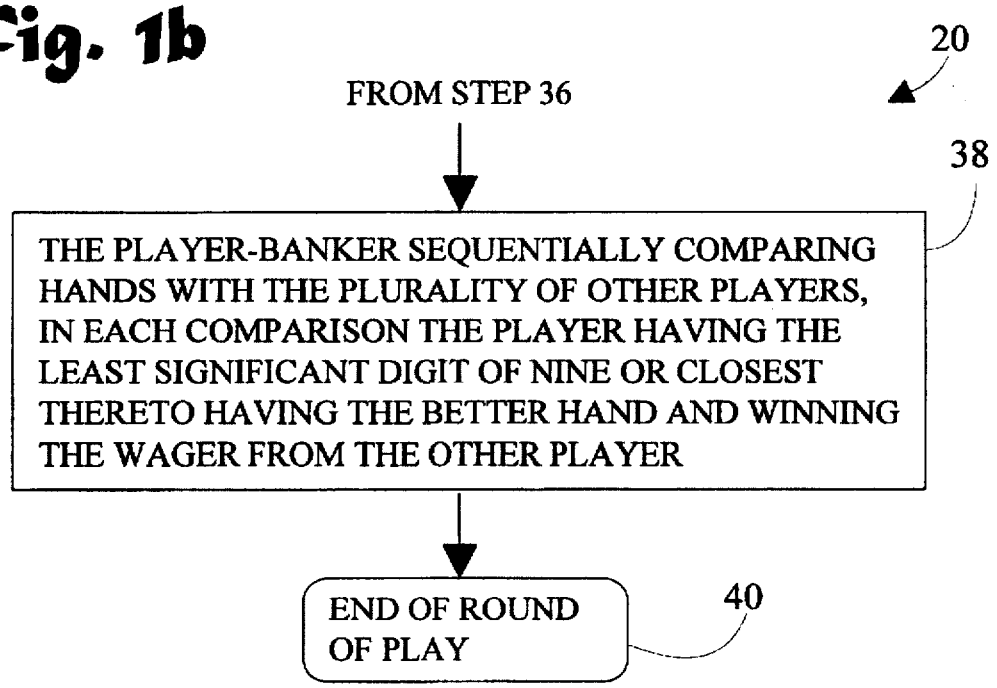
Figure 2:
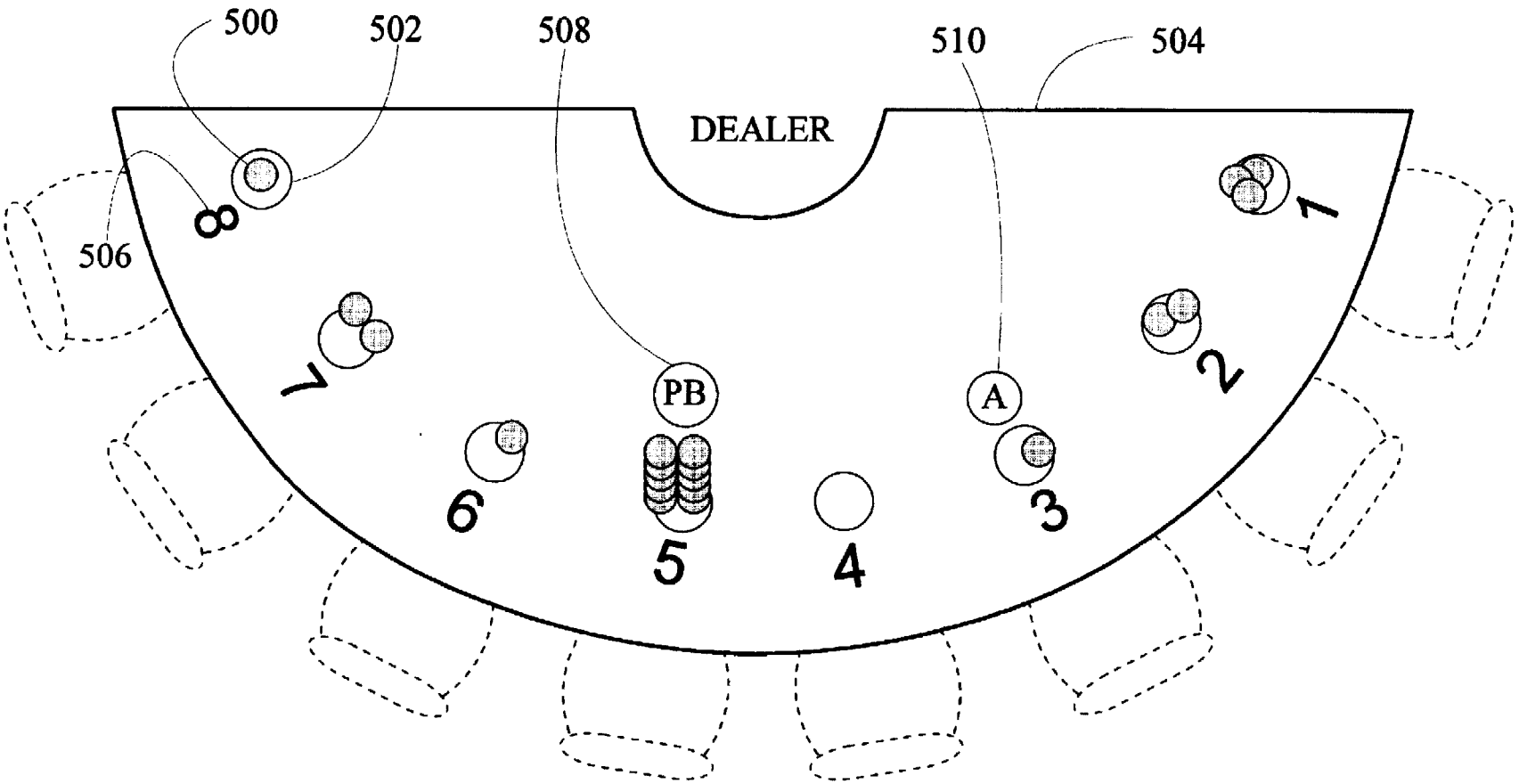
FIG. 2 is a plan view of a playing table layout.

Referring initially to FIGS. 1 and 2, there are depicted a flow diagram and playing table layout illustrating the steps and method of apportioning wagers between a player-banker and a plurality of other players in accordance with the present invention, generally designated as 20. Wagering game 20 may include a plurality of card receiving players, with up to nine being a preferred embodiment, and a dealer, and is especially suited for play at a casino or other gaming establishment.

Referring to FIG. 1 and also to FIG. 2, a round of play (also known as a hand) begins with start terminator step 22. In step 24 at least one deck of playing cards is provided. In a preferred embodiment, six decks are utilized, with the cards being dealt from a shoe. The playing cards have established numerical values, an ace equal to one, picture cards (face cards) equal to zero, and all other cards equaling their face value. That is, a two has a numerical value of two, a three has a numerical value of three, etc. In a preferred embodiment a standard 52 card playing deck is used, however it would also be possible to add one or more additional cards such as aces or jokers to the standard deck, or alternatively remove one or more selected cards. While in a preferred embodiment of the game, playing cards are utilized, it may be readily appreciated that other playing media such as tiles could also be employed. In step 26 a player-banker is determined by methods well known in the gaming art. The player-banker is also sometimes known as the banker or bank hand.

In step 28, each of the players other than the player banker place a wager 500 in betting areas 502 directly in front of them on playing table 504 as shown in FIG. 2. In step 30 the player-banker places a wager 500 which defines a bank. It is noted that steps 28 and 30 may be reversed wherein the other players place their wagers 500 before the player-banker places a wager 500, or steps 28 and 30 may be performed simultaneously. Depending upon gaming establishment rules, wagers 500 may be of several types. In one embodiment the wager 500 are a spread-limit wager 500 which may be for a maximum amount, a minimum amount, or one of a plurality of predetermined incremental values between the two. For example, $10 (minimum), or $15, or $20, or $25, or $30 (maximum). In another embodiment, the wager 500 may be for any amount between a maximum and a minimum. In another embodiment, the wager 500 may be a no-limit wager 500. In another embodiment, the wagers 500 of all players are the same and equal a predetermined table limit. In another embodiment, the players are provided with a plurality of betting areas 502 and may place wagers 500 in each betting area. In FIG. 2, playing position five has been designated the player-banker. In that the players play against the player-banker, the wager 500 of the player-banker will normally be much greater than the individual wagers of the other players, and in fact may be equal to or greater than the sum of the wagers 500 of all the other players. This is called "covering the table". if the wager 500 of the player-banker is less than the sum of the wagers of the other players, it is possible that some of the players will not have their wagers resolved (not "get action", or the "bank not reaching" the player) during the round of play. Additionally, in another embodiment of wagering steps 28 and 30, the player-banker and other players each contribute a predetermined collection amount to the dealer. This collection constitutes payment to the gaming establishment for the cost and profit of conducting the game.

The playing table 504 includes a plurality of numbered playing positions 506, eight in the shown embodiment. Indicia depicting the betting areas 502, playing positions 506, or other pertinent information can be disposed upon the surface of the playing table 504 or a covering thereof. A player-banker marker 508 is placed in front of the player-banker, and an action player marker (button) 510 is placed in front of the selected action player. For simplicity, in FIG. 2 wagers 500, betting areas 502, and playing positions 506 have only been designated for one player. In step 32 a dealer deals a two-card hand to each player including the player-banker. In step 34 each player has the option to either (a) draw an additional card to form a three-card hand, or (b) stand with the original two-card hand. In step 36 the cards in each player's hand are summed (either two or three cards) to form numerical totals, and the least significant digit (LSD) of the numerical totals are determined. In order to expedite play, in a preferred embodiment the summing operation for each player is performed by the dealer. In step 38 the player-banker sequentially compares hands with the plurality of other players, in each comparison the player having an LSD of nine or closest thereto having the better hand and winning the wager from the other player. The ranking of LSD from highest to lowest is nine, eight, seven, six, five, four, three, two, one, and zero. For example if the player-banker's hand is a six plus a two [the LSD is 8 (6+2)], and if the contending (comparing) player's hand is a four plus a three plus a two [the LSD is 9 (4+3+2)], the contending player has the better hand and would win the wager from the player-banker. It should be pointed out that if the wagers 500 of the player-banker and the contending player are different, and they usually will be, it is the lesser wager 500 which determines the amount which is won or lost.

In a preferred embodiment, a procedure for eliminating ties is included. If the player-banker and the contending player each have the same LSD, the player having the highest ranking single card has the better hand. The ranking of the single cards from highest to lowest is, nine, eight, seven, six, five, four, three, two, ace (one), king, queen, jack, and ten. Therefore a seven plus an ace (LSD of 8) would beat a six plus a two (LSD of 8), since the seven is the highest ranking card. Similarly, a two plus a three plus a four (LSD of 9) would lose to a six plus a three (LSD of 9), since the six is the highest ranking single card.

If the player-banker and the contending player each have the same LSD and also have the same highest ranking single card, the player having the highest ranking second card has the better hand. For example an eight plus a king (LSD of 8 and highest single card of 8) would beat an eight plus a jack (LSD of 8 and highest single card of 8), since a king outranks a jack. Finally, if the player-banker and the contending player have identical hands, the player-banker is declared the winner.

It may be appreciated that numerous other tie-breaking procedures could also be employed. For example, the poker ranking of the competing hands could be used to determine the winner, or the most significant digit could be used, or the color of the card, etc.

After the player-banker has sequentially compared hands and settled wagers 500 with each of the other players, play proceeds to end terminator 40 and the round of play is ended.

In a preferred embodiment wagering game 20 further includes the step of determining an action player (sometimes called an action hand or action position). The action player is the first player to be dealt cards, and compare and settle a wager with the player-banker. Also, the step of the player-banker comparing hands and settling wagers with the plurality of other players can proceed in a clockwise direction which is preferred, or in a counterclockwise direction.

Figure 3:
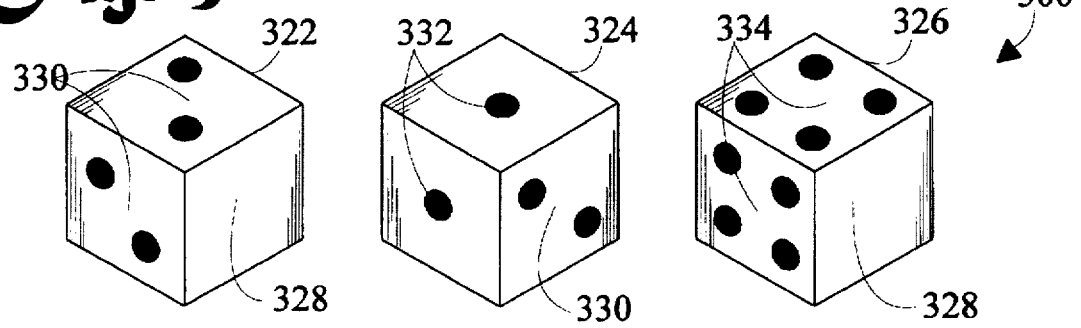
FIG. 3 is a perspective front view of a first set of special dice which produce a range of numerical values one through eight.
Figure 4:
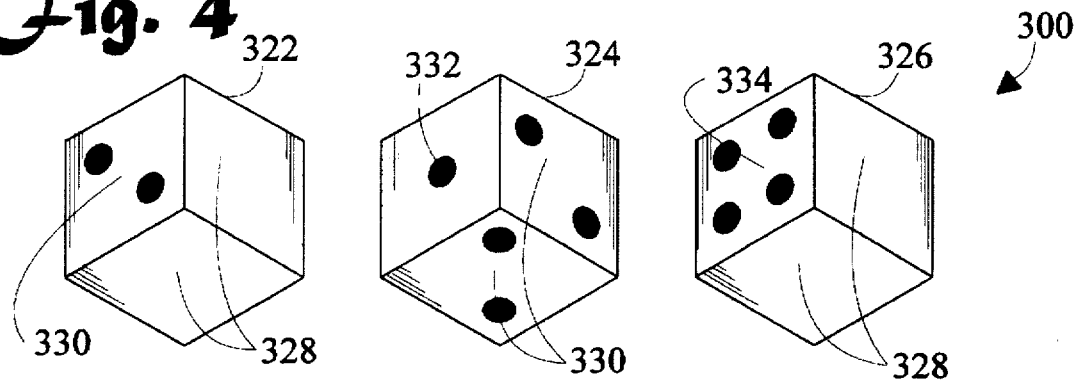
FIG. 4 is a perspective back view of the first set of special dice of FIG. 3.

In a preferred embodiment, a set of special dice are utilized to determine the action player. FIG. 3 is a perspective front view of a first set of special dice 300 which produce a range of numerical values one through eight, and FIG. 4 is a perspective back view of the first set of special dice of FIG. 3. The range of numerical values produced is the numerical total of the uppermost side of the set of dice 300 after the dice are rolled. The plurality of dice 300 each have a representation of a selected number (including zero)

disposed on each of its six sides. In the embodiment shown, the set of special dice 300 includes a first die 322, a second die 324, and a third die 326. First die 322 has a representation of the number zero 328 (blank in the shown embodiment) disposed on three of its sides, and a representation of the number two 330 disposed on three of its sides. Second die 324 has a representation of the number one 332 disposed on three of its sides, and a representation of the number two 330 disposed on three of its sides. Third die 326 has a representation of the number zero 328 disposed on three of its sides, and a representation of the number four 334 disposed on three of its sides. As is the case for conventional dice, in the shown embodiment dots are used to represent the selected numbers. However, other representations such as lines, numerals, or even written words could also be employed.

Table 1 illustrates all possible combinations of numerical values produced by the set of special dice 300. It is noted that the range of numerical values produced is one through eight, and that each numerical value within the range has an equal 0.125 probability of being produced. This feature of the present invention is in marked contrast to a set of three conventional dice, wherein, depending upon the number of players, the probability of producing a given number may vary, and furthermore not all numbers have an equal probability of being produced. An important aspect of the present invention is the fact that the set of special dice 300 gives a direct indication of the selected

TABLE 1

| First Die | Second Die | Third Die | Numerical Value Produced |
|---|---|---|---|
| 0(blank) | 1 | 0 | 1 |
| 0 | 1 | 4 | 5 |
| 0 | 2 | 0 | 2 |
| 0 | 2 | 4 | 6 |
| 2 | 1 | 0 | 3 |
| 2 | 1 | 4 | 7 |
| 2 | 2 | 0 | 4 |
| 2 | 2 | 4 | 8 |

player or playing position, and additionally that the numerical total of the set of special dice 300 can never exceed eight. For example, in an eight handed game if the numerical total of the set of special dice 300 is three, then the third player or playing position is selected. Conversely, with three conventional dice one and two can never be rolled, and counting must be performed if the rolled number exceeds eight. If the number of an unoccupied playing position or the player-banker is produced, then the next sequential player becomes the action player.

The method for producing a range of numerical values from one through eight consists simply of the providing the set of special dice 300, and rolling the three dice to produce one of the numbers one through eight. For example in FIG. 2, each player has a numbered playing position 506 ranging from one to eight. The set of special dice 300 are rolled, and the total numerical value of the dice ranges from one to eight, the action player is then the player whose numbered playing position equals the total numerical value of the three dice 300.

Figure 5:
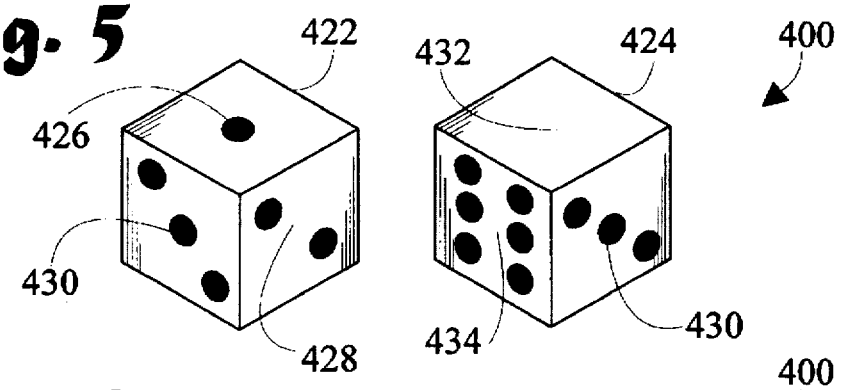
FIG. 5 is a perspective front view of a second set of special dice which produce a range of numerical values one through nine.
Figure 6:
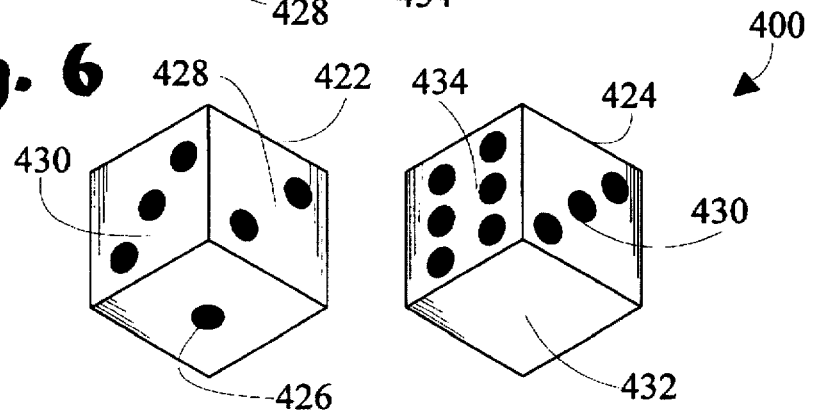
FIG. 6 is a perspective back view of the second set of special dice of FIG. 5; and, FIG. 7 is a flow diagram illustrating the steps and method of play of a second embodiment of the wagering game.

Referring now to FIGS. 5 and 6, there are depicted perspective front and back views of a second set of special dice 400 which produce a range of numerical values one through nine. Set of special dice 400 are useful when wagering game 20 is played by up to nine players. The plurality of dice 400 each have a representation of a selected number (including zero) disposed on each of its six sides. In the embodiment shown, the set of special dice 400 includes a first die 422 and a second die 424. First die 422 has a representation of the number one 426 disposed on two of its sides, a representation of the number two 428 disposed on two of its sides, and a representation of the number three 430 disposed on two of its sides. Second die 424 has a representation of the number zero 432 disposed on two of its sides, a representation of the number three 430 disposed on two of its sides, and a representation of the number six 434 disposed on two of its sides.

Table 2 illustrates all possible combinations of numerical values produced by the set of special dice 400. It is noted that the range of numerical values produced is one through nine, and that each numerical value within the range has an equal 0.111 probability of being produced. If the number of an unoccupied playing position or the player-banker is produced, then the next sequential player becomes the action player.

TABLE 2

| First Die | Second Die | Numerical Value Produced |
|---|---|---|
| 1 | 0(blank) | 1 |
| 1 | 3 | 4 |
| 1 | 6 | 7 |
| 2 | 0 | 2 |
| 2 | 3 | 5 |
| 2 | 6 | 8 |
| 3 | 0 | 3 |
| 3 | 3 | 6 |
| 3 | 6 | 9 |

As was previously disclosed, in step 38 of FIG. 1, the player-banker sequentially compares hands and settles wagers 500 with the plurality of other players, the comparing and settling usually beginning with the action player. In one common playing embodiment, after the wager 500 is settled, the bank is incrementally reduced by an amount equal to each settled wager 500 thereby forming a remaining bank (also called an "amount at risk"). That is, each time a wager 500 is settled, regardless whether the player-banker or the player wins, the bank (or subsequently the remaining bank) is reduced by the amount of the wager 500 which is won or lost. If at some point during the round of play the remaining bank is reduced to zero so that the wagers 500 of all the players cannot be settled, a secondary player-banker is determined. The secondary player-banker replaces the player-banker, and continues to sequentially compare hands and settle wagers 500 with the remaining players. This playing format is known as "Secondary Pot".

Figure 7A:
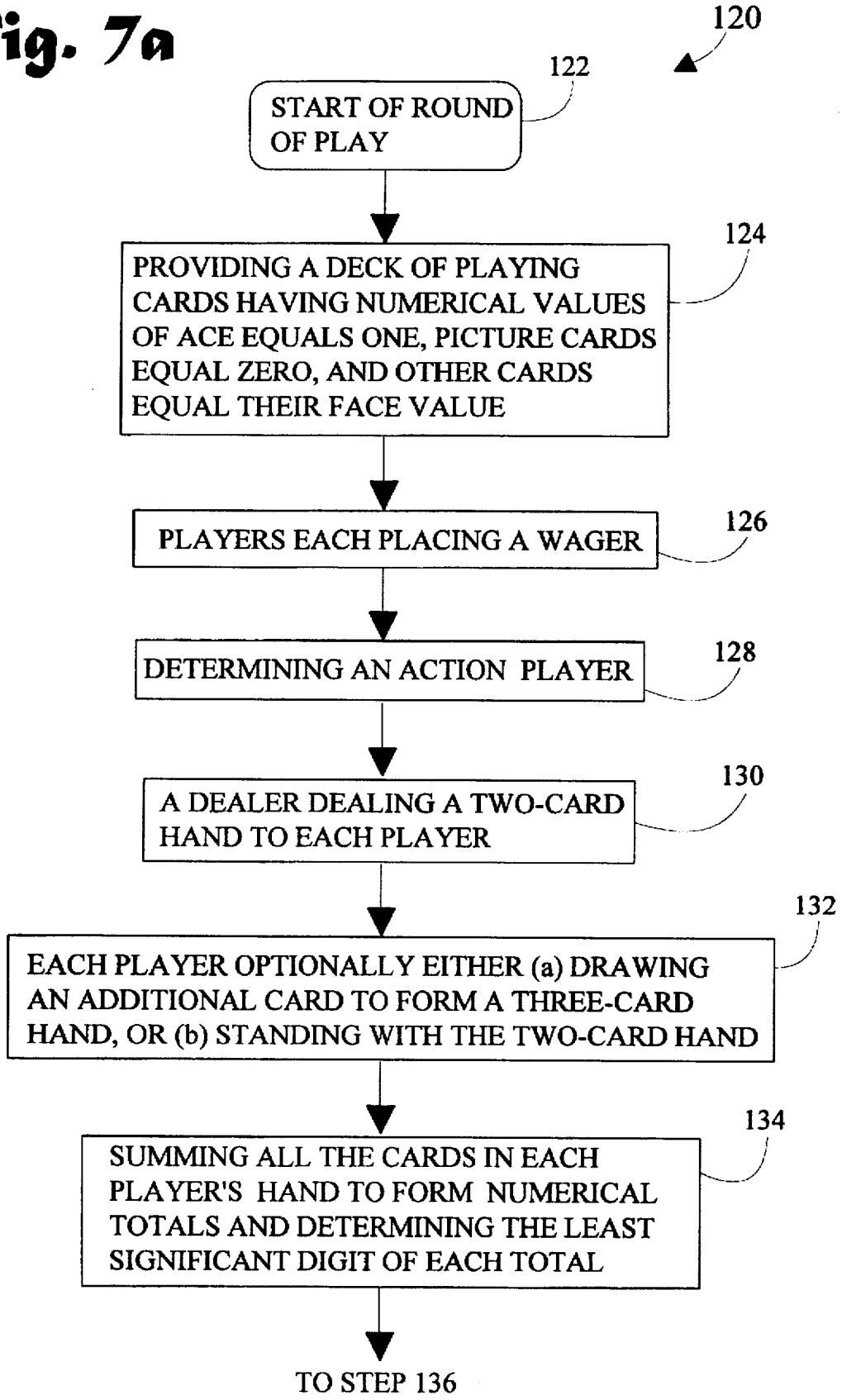
Figure 7B:
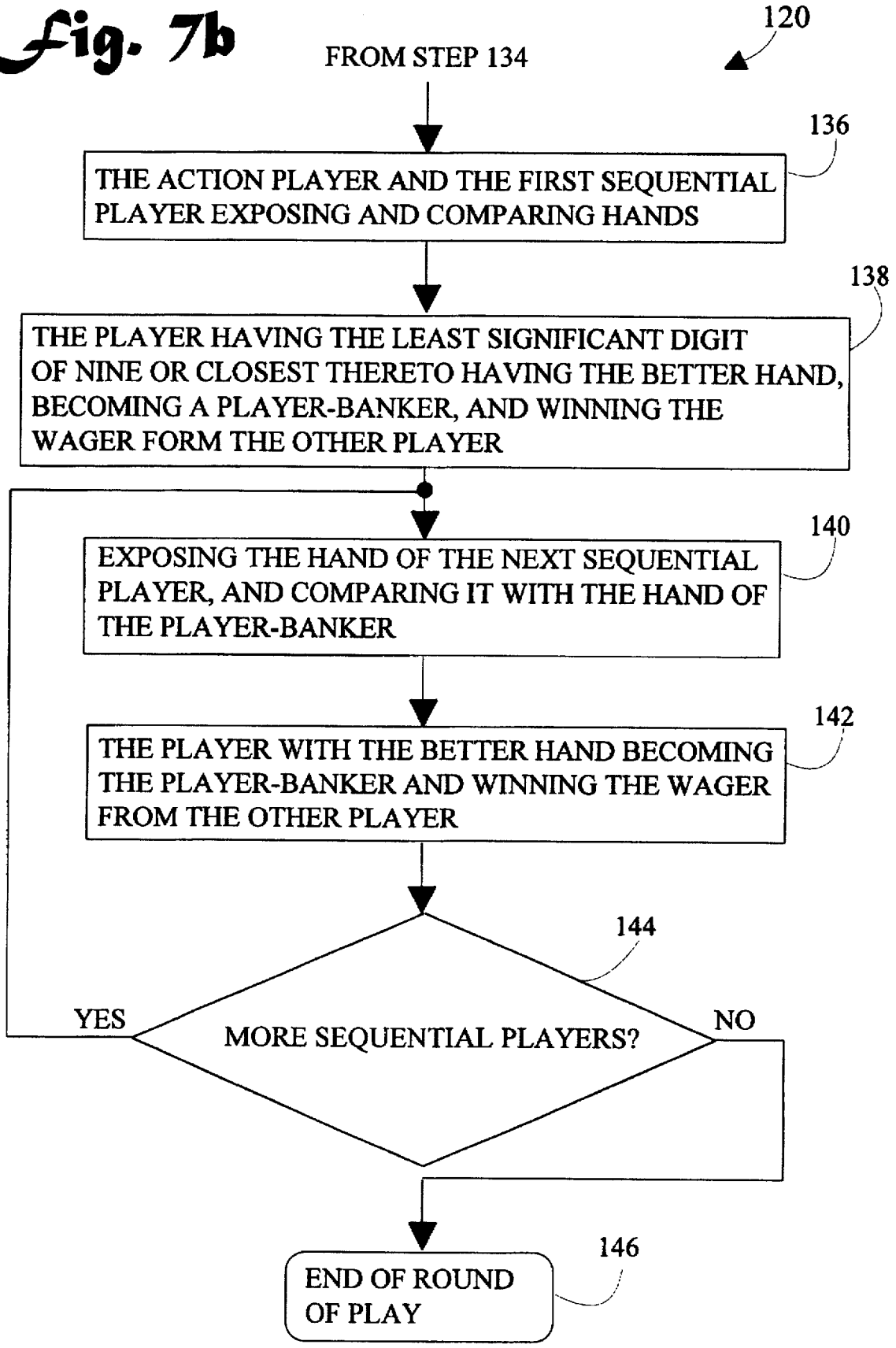

FIG. 7 is a flow diagram illustrating the steps and method of play of a second embodiment of the wagering game in accordance with the present invention, generally designated as 120. In this embodiment the player-banker is not fixed throughout the hand, but rather the role of player-banker can move during the play of the game from player to player depending upon which player has the better hand. If a player wins the wager 500, he or she becomes the player-banker for the next exposure and comparison of hands, and settlement of the wager 500 with the contending player. The playing table layout for this banking embodiment is similar to that of wagering game 20 shown in FIG. 2, with the exception that the player-banker (playing position 5) will no longer have to make a wager 500 that is substantially larger than those of the other players. Also of great importance, since the role of player-banker transfers to the player with the better hand, every player will "get action" every hand.

Referring to FIG. 7 and also to FIG. 2, a round of play (also known as a hand) begins with start terminator step 122.

In step 124 at least one deck of playing cards is provided. In a preferred embodiment, six decks are utilized, with the cards being dealt from a shoe. The playing cards have established numerical values, an ace equal to one, picture cards (face cards) equal to zero, and all other cards equaling their face value. That is, a two has a numerical value of two, a three has a numerical value of three, etc. In a preferred embodiment a standard 52 card playing deck is used, however it would also be possible to add one or more additional cards such as aces or jokers to the standard deck, or alternatively remove one or more selected cards such as in a deck for playing Pan 9. While in a preferred embodiment of the game, playing cards are utilized, it may be readily appreciated that other playing media such as tiles could also be employed. In step 126, each of the players place a wager 500 in betting areas 502 directly in front of them on playing table 504 as shown in FIG. 2. In step 128 an action player is determined by methods well known in the gaming art, or by using the sets of special dice disclosed in FIGS. 3 through 6 herein. As was the case for the wagering game 20, depending upon gaming establishment rules, wagers 500 may be of several types. Additionally, the players may each contribute a predetermined collection amount to the dealer.

In step 130 a dealer deals a two-card hand to each player. In step 132 each player has the option to either (a) draw an additional card to form a three-card hand, or (b) stand with the original two-card hand. In step 134 the cards in each player's hand are summed (either two or three cards) to form a numerical total, and the least significant digit (LSD) of the numerical total is determined. In order to expedite play, in a preferred embodiment the summing operation for each player is performed by the dealer. In step 136 the action player and the first sequential player expose and compare hands. The exposure and comparison may proceed in a clockwise direction which is preferred, or in a counterclockwise direction. In step 138 the player having an LSD of nine or closest thereto has the better hand, becomes the player-banker, and wins the wager 500 from the other player. The ranking of hands and cards, and the rules for breaking ties are the same as in wagering game 20, with the addition that if the action player and the first sequential player have identical hands, the action player is declared the winner, wins the wager 500, and continues play. Also, if the wagers 500 of two contending players are different, it is the lesser wager 500 which determines the amount which is won or lost.

In step 140 the hand of the next sequential player is exposed and compared with the hand of the player-banker. In step 142 the player having the better hand becomes (or remains) the player-banker and wins the wager 500 from the other player. In step 144 it is determined if there are more sequential players. If there are more sequential players (Yes), steps 140, 142, and 144 are repeated until all players have participated. If there are no more sequential players (No), play proceeds to end terminator 146 and the round of play is ended.

It may be appreciated that while in a preferred embodiment of the present invention a player receives two cards and has the option of drawing a third card, the teachings contained herein may also be applied to a game wherein a player receives three cards and has the option of drawing a fourth card. All other features and embodiments of wagering games 20 and 120 are as previously described. One addition in three/optional four card playing format, is the if the players tie and each have the same highest ranking first, second, and third cards, the player having the highest ranking fourth card has the better hand.

The preferred embodiments of the invention described herein are exemplary and numerous modifications, procedural variations, rearrangements, and adjustments can be readily envisioned to achieve an equivalent result, all of which are intended to be embraced within the scope of the appended claims.

I claim:

1. A method of apportioning wagers between a player-banker and a plurality of other players comprising the steps of:

providing at least one deck of playing cards, said playing cards having numerical values, said values being ace equals one, picture cards equal zero, and all other cards equaling their face value;

determining a player-banker;

the players each placing a wager;

the player-banker placing a wager defining a bank;

a dealer dealing a two-card hand to each player;

each player optionally either (a) drawing an additional card to form a three-card hand, or (b) standing with said two-card hand;

the cards in each player's hand being summed to form numerical totals, and determining the least significant digit of said numerical totals;

the player-banker sequentially comparing hands with the plurality of other players, in each comparison the player having said least significant digit of nine or closest thereto having the better hand and winning the wager from the other player;

wherein the bank is incrementally reduced by an amount equal to each wager won by each player winning over the player-banker to form a remaining bank, and when the remaining bank is reduced to zero before settling the wagers of all the remaining players, determining a secondary player-banker; and, said secondary player-banker replacing the player-banker and continuing to sequentially compare hands and settle wagers with the remaining players.

2. The method according to claim 1, wherein the ranking of said least significant digit from highest to lowest is; nine, eight, seven, six, five, four, three, two, one, and zero.

3. The method according to claim 1, wherein said step of the player-banker sequentially comparing hands with the plurality of other players proceeds in one of a clockwise direction and a counterclockwise direction.

4. A method of apportioning wagers between a plurality of game players comprising the steps of:

providing at least one deck of playing cards, said playing cards having numerical values, said values being ace equals one, picture cards equal zero, and all other cards equaling their face value;

the players each placing a wager;

a dealer dealing a two-card hand to each player;

each player optionally either (a) drawing an additional card to form a three-card hand, or (b) standing with said two-card hand;

the cards in each player's hand being summed to form numerical totals, and determining the least significant digit of said numerical totals;

the player having said least significant digit of nine or closest thereto having the best hand; and, further including a procedure for eliminating ties wherein a ranking of cards determines a winner.

5. The method according to claim 4, wherein said procedure for eliminating ties includes the player having the highest ranking single card having the better hand.

6. The method according to claim 5, wherein the ranking of said single card from highest to lowest is; nine, eight, seven, six, five, four, three, two, ace, king, queen, jack, and ten.

7. The method according to claim 6, wherein if the players each have the same highest ranking single card, the player having the highest ranking second card having the better hand.

8. The method according to claim 7, wherein if the players each have the same highest ranking second card, the player having the highest ranking third card having the better hand.

9. The method according to claim 8, further including one of the players being designated as a player-banker, and wherein if the players have identical hands, the player-banker is declared the winner.

10. A method of apportioning wagers between a player-banker and a plurality of other players comprising the steps of:

providing at least one deck of playing cards, said playing cards having numerical values, said values being ace equals one, picture cards equal zero, and all other cards equaling their face value;

determining a player-banker;

providing a set of dice;

using said set of dice to determine an action player;

the players each placing a wager;

the player-banker placing a wager defining a bank;

a dealer dealing a two card hand to each player;

each player optionally either (a) drawing an additional card to form a three-card hand, or (b) standing with said two-card hand;

the cards in each player's hand being summed to form numerical totals, and determining the least significant digit of said numerical totals;

commencing with the action player the player-banker sequentially comparing hands with the plurality of other players, in each comparison the player having said least significant digit of nine or closest thereto having the better hand and winning the wager from the other player;

said set of dice further including:

a first die having three blank sides and three sides marked with a representation of the number two;

a second die having three sides marked with a representation of the number one and three sides marked with a representation of the number two; and, a third die having three blank sides and three sides marked with a representation of the number four.

11. The method according to claim 10, further including:

in the step of determining an action player, each player having a numbered playing position ranging from one to eight, said set of dice are rolled, the total numerical value of said set of dice ranging from one to eight, the action player being the player whose numbered playing position equals said total numerical value of said set of dice.

12. A method of apportioning wagers between a player-banker and a plurality of other players comprising the steps of:

providing at least one deck of playing cards, said playing cards having numerical values, said values being ace equals one, picture cards equal zero, and all other cards equaling their face value;

determining a player-banker;

providing a set of dice;

using said set of dice to determine an action player;

the players each placing a wager;

the player-banker placing a wager defining a bank;

a dealer dealing a two card hand to each player;

each player optionally either (a) drawing an additional card to form a three-card hand, or (b) standing with said two-card hand;

the cards in each player's hand being summed to form numerical totals, and determining the least significant digit of said numerical totals;

said set of dice further including:

a first die having a representation of the number one disposed on two sides, a representation of the number two disposed on two sides, and a representation of the number three disposed on two sides; and, a second die having a representation of the number zero disposed on two sides, a representation of the number three disposed on two sides, and a representation of the number six disposed on two sides.

13. The method according to claim 12, further including:

in the step of determining an action player, each player having a numbered playing position ranging from one to nine, said set of dice are rolled, the total numerical value of said set of dice ranging from one to nine, the action player being the player whose numbered playing position equals said total numerical value of said set of dice.

14. A method of apportioning wagers between a plurality of game players comprising the steps of:

providing at least one deck of playing cards, said playing cards having numerical values, said values being ace equals one, picture cards equal zero, and all other cards equaling their face value;

the players each placing a wager;

determining an action player;

a dealer dealing a card two-hand to each player;

each player optionally either (a) drawing an additional card to form a three-card hand, or (b) standing with said two-card hand;

the cards in each player's hand being summed to form numerical totals, and determining the least significant digit of said numerical totals;

the action player and a first sequential player exposing and comparing hands;

the player having said least significant digit of nine or closest thereto having the better hand, becoming a player-banker, and winning the wager from the other player;

exposing the hand of the next sequential player and comparing it with the hand of the player-banker;

the player with the better hand becoming the player-banker and winning said wager from the other player; and, repeating said steps of exposing the hand of the next sequential player and comparing it with the hand of the player-banker, and the player with the better hand becoming the player-banker and winning said wager from the other player, until all players have participated.

15. A method of apportioning wagers between a player-banker and a plurality of other players comprising the steps of:

providing at least one deck of playing cards, said playing cards having numerical values, said values being ace equals one, picture cards equal zero, and all other cards equaling their face value;

determining a player-banker;

the players each placing a wager;

the player-banker placing a wager defining a bank;

a dealer dealing a three-card hand to each player;

each player optionally either (a) drawing an additional card to form a four-card hand, or (b) standing with said three-card hand;

the cards in each player's hand being summed to form numerical totals, and determining the least significant digit of said numerical totals;

the player-banker sequentially comparing hands with the plurality of other players, in each comparison the player having said least significant digit of nine or closest thereto having the better hand and winning the wager from the other player;

wherein the bank is incrementally reduced by an amount equal to each wager won by each player winning over the player-banker to form a remaining bank, and when the remaining bank is reduced to zero before settling the wagers of all the remaining players, determining a secondary player-banker; and, said secondary player-banker replacing the player-banker and continuing to sequentially compare hands and settle wagers with the remaining players.

16. The method according to claim 15, wherein the ranking of said least significant digit from highest to lowest is; nine, eight, seven, six, five, four, threes two, one, and zero.

17. The method according to claim 15, wherein said step of the player-banker sequentially comparing hands with the plurality of other players proceeds in one of a clockwise direction and a counterclockwise direction.

18. A method of apportioning wagers between a plurality of game players comprising the steps of:

providing at least one deck of playing cards, said playing cards having numerical values, said values being ace equals one, picture cards equal zero, and all other cards equaling their face value;

the players each placing a wager;

a dealer dealing a three-card hand to each player;

each player optionally either (a) drawing an additional card to form a four-card hand, or (b) standing with said three-card hand;

the cards in each player's hand being summed to form numerical totals, and determining the least significant digit of said numerical totals;

the player having said least significant digit of nine or closest thereto having the best hand; and, further including a procedure for eliminating ties wherein a ranking of cards determines a winner.

19. The method according to claim 18, wherein said procedure for eliminating ties includes the player having the highest ranking single card having the better hand.

20. The method according to claim 19, wherein the ranking of said single card from highest to lowest is; nine, eight, seven, six, five, four, three, two, ace, king, queen, jack, and ten.

21. The method according to claim 20, wherein if the players each have the same highest ranking single card, the player having the highest ranking second card having the better hand.

22. The method according to claim 21, wherein if the players each have the same highest ranking second card, the player having the highest ranking third card having the better hand.

23. The method according to claim 22, wherein if the players each have the same highest ranking third card, the player having the highest ranking fourth card having the better hand.

24. The method according to claim 23, further including one of the players being designated as a player-banker, and wherein if the players have identical hands, the player-banker is declared the winner.

25. A method of apportioning wagers between a player-banker and a plurality of other players comprising the steps of:

providing at least one deck of playing cards, said playing cards having numerical values, said values being ace equals one, picture cards equal zero, and all other cards equaling their face value;

determining a player-banker;

providing a set of dice;

using said set of dice to determine an action player;

the players each placing a wager;

the player-banker placing a wager defining a bank;

a dealer dealing a three card hand to each player;

each player optionally either (a) drawing an additional card to form a four-card hand, or (b) standing with said three-card hand;

the cards in each player's hand being summed to form numerical totals, and determining the least significant digit of said numerical totals;

commencing with the action player the player-banker sequentially comparing hands with the plurality of other players, in each comparison the player having said least significant digit of nine or closest thereto having the better hand and winning the wager from the other player;

said set of dice further including:

a first die having three blank sides and three sides marked with a representation of the number two;

a second die having three sides marked with a representation of the number one and three sides marked with a representation of the number two; and, a third die having three blank sides and three sides marked with a representation of the number four.

26. The method according to claim 25, further including:

in the step of determining an action player, each player having a numbered playing position ranging from one to eight, said set of dice are rolled, the total numerical value of said set of dice ranging from one to eight, the action player being the player whose numbered playing position equals said total numerical value of said set of dice.

27. A method of apportioning wagers between a player-banker and a plurality of other players comprising the steps of:

providing at least one deck of playing cards, said playing cards having numerical values, said values being ace equals one, picture cards equal zero, and all other cards equaling their face value;

determining a player-banker;

providing a set of dice;

using said set of dice to determine an action player;

the players each placing a wager;

the player-banker placing a wager defining a bank;

a dealer dealing a three card hand to each player;

each player optionally either (a) drawing an additional card to form a four-card hand, or (b) standing with said three-card hand;

the cards in each player's hand being summed to form numerical totals, and determining the least significant digit of said numerical totals;

commencing with the action player the player-banker sequentially comparing hands with the plurality of other players, in each comparison the player having said least significant digit of nine or closest thereto having the better hand and winning the wager from the other player;

said set of dice further including:

a first die having a representation of the number one disposed on two sides, a representation of the number two disposed on two sides, and a representation of the number three disposed on two sides; and, a second die having a representation of the number zero disposed on two sides, a representation of the number three disposed on two sides, and a representation of the number six disposed on two sides.

28. The method according to claim 27, further including:

in the step of determining an action player, each player having a numbered playing position ranging from one to nine, said set of dice are rolled, the total numerical value of said set of dice ranging from one to nine, the action player being the player whose numbered playing position equals said total numerical value of said set of dice.

29. A method of apportioning wagers between a plurality of game players comprising the steps of:

providing at least one deck of playing cards, said playing cards having numerical values, said values being ace equals one, picture cards equal zero, and all other cards equaling their face value;

the players each placing a wager;

determining an action player;

a dealer dealing a three-card hand to each player;

each player optionally either (a) drawing an additional card to form a four-card hand, or (b) standing with said three-card hand;

the cards in each player's hand being summed to form numerical totals, and determining the least significant digit of said numerical totals;

the action player and a first sequential player exposing and comparing hands;

the player having said least significant digit of nine or closest thereto having the better hand, becoming a player-banker, and winning the wager from the other player;

exposing the hand of the next sequential player and comparing it with the hand of the player-banker;

the player with the better hand becoming the player-banker and winning said wager from the other player; and, repeating said steps of exposing the hand of the next sequential player and comparing it with the hand of the player-banker, and the player with the better hand becoming the player-banker and winning said wager from the other player, until all players have participated.

* * * * *